US009700752B1

(12) United States Patent
Powers

(10) Patent No.: US 9,700,752 B1
(45) Date of Patent: Jul. 11, 2017

(54) STRETCH TRAINING TOOL

(71) Applicant: Scott Powers, Fayetteville, AR (US)

(72) Inventor: Scott Powers, Fayetteville, AR (US)

( * ) Notice: Subject to any disclaimer, the term of this patent is extended or adjusted under 35 U.S.C. 154(b) by 4 days.

(21) Appl. No.: 14/731,144

(22) Filed: Jun. 4, 2015

(51) Int. Cl.
*A63B 21/055* (2006.01)

(52) U.S. Cl.
CPC ..... *A63B 21/0557* (2013.01)

(58) Field of Classification Search
CPC ..... A63B 21/0552; A63B 21/0004; A63B 21/0557; A63B 21/0442; A63B 2208/0204; A63B 21/00069; A63B 21/00185; A63B 21/4025; A63B 21/4015; A63B 21/0555; A63B 21/00061; A63B 21/4035; A63B 23/1209; A63B 2023/006; A63B 21/4017; A63B 21/4043; A63B 23/03575
USPC ..... 482/121–126, 131, 134–137; D21/662, D21/692; 602/4
See application file for complete search history.

(56) References Cited

U.S. PATENT DOCUMENTS 324,498 A 8/1885 Surbaugh
2,224,103 A * 12/1940 Nilson ..... A63B 21/0004 482/122
3,119,614 A 1/1964 Berry ..... 272/79
3,369,809 A 2/1968 Morrill, Jr. ..... 272/79
3,529,820 A * 9/1970 Templeton ..... A63B 21/0004 482/122
3,838,852 A * 10/1974 Gury ..... A63B 21/0004 482/125
3,843,119 A 10/1974 Davis ..... 272/79
3,912,266 A * 10/1975 Gury ..... A63B 21/0004 273/159
3,925,901 A 12/1975 McCormick ..... 33/137
4,019,734 A * 4/1977 Lee ..... A63B 21/0552 482/125
4,026,549 A * 5/1977 Gunn ..... A63B 21/0004 473/464
4,040,620 A * 8/1977 Friedman ..... A63B 21/0552 482/125
4,090,706 A * 5/1978 Reda ..... A63B 21/0004 482/122
4,177,542 A 12/1979 Denney ..... 24/115
4,277,062 A 7/1981 Lawrence ..... 272/126
4,456,247 A 6/1984 Ehrenfried ..... 272/126
4,588,186 A 5/1986 Calabrese ..... 272/126
4,685,671 A * 8/1987 Hagerman ..... A63B 21/04 482/124
4,819,936 A 4/1989 Muller ..... 272/126
4,852,874 A * 8/1989 Sleichter, III ..... A63B 21/0004 482/122
5,004,228 A 4/1991 Powers ..... 272/125
5,277,680 A 1/1994 Johnston ..... 482/95
5,498,218 A * 3/1996 Proctor ..... A63B 23/025 482/10

(Continued)

*Primary Examiner* — Andrew S Lo
(74) *Attorney, Agent, or Firm* — Keisling & Pieper PLC; David B. Pieper

(57) ABSTRACT

A dynamic body stretching device with an elastic loop stitched to a static loop. The elastic loop forms a hand strap with a threaded on end grip handle. The static loop forms a foot loop. Between the elastic loop and the foot loop are threaded on handgrips held in position by buckle type strap locks. The handgrips have mirrored end ovoid shape allowing gripping and pulling from alternative directions.

7 Claims, 7 Drawing Sheets

(56) References Cited

U.S. PATENT DOCUMENTS 5,569,137 A * 10/1996 Uen ..... A63B 21/0004 482/121
5,813,954 A * 9/1998 Wilkinson ..... A63B 21/0004 482/124
5,921,903 A * 7/1999 Lawrence ..... A63B 23/0211 482/131
5,984,845 A 11/1999 Powers ..... 482/148
6,036,626 A * 3/2000 Taylor ..... A63B 21/0004 482/121
D437,623 S * 2/2001 Ormsby ..... D21/662
6,338,700 B1 * 1/2002 Pollock ..... A63B 21/154 482/904
6,368,258 B1 * 4/2002 Emlaw ..... A63B 21/0004 482/124
6,450,929 B1 * 9/2002 Markham ..... A63B 21/0552 482/121
6,450,930 B1 9/2002 Kroke ..... 482/121
6,840,894 B2 1/2005 Lerner ..... 482/124
7,014,602 B2 3/2006 Yamauchi ..... 482/142
7,153,247 B1 12/2006 Filkoff ..... 482/121
7,172,534 B1 2/2007 Joy et al. ..... 482/82
7,223,212 B2 * 5/2007 DiOrio ..... A63B 21/0023 482/83
7,476,182 B2 1/2009 DeNisco ..... 482/92
7,794,374 B1 * 9/2010 Park ..... A63B 21/0004 482/122
7,955,236 B2 6/2011 DiGiovanni et al. ..... 482/124
7,998,034 B1 * 8/2011 Cobo ..... A63B 69/0028 482/126
8,038,584 B1 10/2011 Pruessner et al. ..... 482/91
D654,124 S * 2/2012 Davis ..... D21/662
8,317,667 B1 * 11/2012 Thomas ..... A63B 21/0555 482/121
D678,434 S * 3/2013 Hughes ..... D21/662
8,814,762 B2 8/2014 Butler et al. ..... 482/96
8,821,359 B1 9/2014 Kassel ..... 482/121
8,864,637 B2 10/2014 Leirer ..... 482/121
8,944,976 B2 2/2015 Crowell et al. ..... 482/125
8,961,376 B2 2/2015 Sweeney et al. ..... 482/121
D726,262 S * 4/2015 Linkjendal ..... D21/662
9,017,235 B2 4/2015 Khademi ..... 482/79
2004/0157710 A1 * 8/2004 Basting ..... A63B 21/0004 482/126
2004/0204302 A1 * 10/2004 Flynn ..... A63B 21/0004 482/124
2005/0085350 A1 * 4/2005 Shen ..... A63B 23/00 482/91
2010/0216613 A1 * 8/2010 Pacini ..... A63B 21/0552 482/122
2010/0317495 A1 * 12/2010 DiGiovanni et al. ..... A63B 21/0552 482/129
2011/0047943 A1 * 3/2011 Burns ..... B68B 1/06 54/9
2011/0269605 A1 * 11/2011 Kim ..... A63B 21/4035 482/121
2011/0306477 A1 * 12/2011 Keen ..... A63B 21/02 482/122
2013/0143724 A1 * 6/2013 DeMeo ..... A63B 21/00185 482/131
2014/0329650 A1 11/2014 Watry ..... 482/139
2014/0336014 A1 * 11/2014 Francis ..... A63B 69/203 482/88

* cited by examiner

STRETCH TRAINING TOOL

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in exercise equipment. More particularly, the invention relates to improvements particularly suited for a stretching apparatus that allows dynamic, active, and static stretching.

2. Description of the Known Art

As will be appreciated by those skilled in the art, exercise and/or stretching devices are known in various forms. Patents disclosing information relevant to various aspects of exercising and stretching include: U.S. Pat. No. 5,984,845 issued to Powers on Nov. 16, 1999; U.S. Pat. No. 5,004,228 issued to Powers on Apr. 2, 1991; U.S. Pat. No. 9,017,235, issued to Khademi on Apr. 28, 2015; U.S. Pat. No. 8,961,376 issued to Sweeney, et al. on Feb. 24, 2015; U.S. Pat. No. 8,944,976 issued to Crowell, et al. on Feb. 3, 2015; U.S. Pat. No. 8,864,637, issued to Leirer on Oct. 21, 2014; U.S. Pat. No. 8,821,359 issued to Kassel on Sep. 2, 2014; U.S. Pat. No. 8,814,762 issued to Butler, et al. on Aug. 26, 2014; U.S. Pat. No. 4,277,062 issued to Lawrence on Jul. 7, 1981; U.S. Pat. No. 8,038,584 issued to Pruessner, et al. on Oct. 18, 2011; U.S. Pat. No. 7,955,236 issued to DiGiovanni, et al. on Jun. 7, 2011; U.S. Pat. No. 7,476,182 issued to DeNisco on Jan. 13, 2009; U.S. Pat. No. 7,172,534 issued to Joy, et al. on Feb. 6, 2007; U.S. Pat. No. 7,153,247 issued to Filkoff on Dec. 26, 2006; U.S. Pat. No. 7,014,602 issued to Yamauchi on Mar. 21, 2006; U.S. Pat. No. 6,840,894 issued to Lerner on Jan. 11, 2005; U.S. Pat. No. 6,450,930 issued to Kroke on Sep. 17, 2002; U.S. Pat. No. 5,277,680 issued to Johnston on Jan. 11, 1994; U.S. Pat. No. 4,819,936 issued to Muller on Apr. 11, 1989; U.S. Pat. No. 4,588,186 issued to Calabrese on May 13, 1986; U.S. Pat. No. 4,456,247 issued to Ehrenfried on Jun. 26, 1984; U.S. Pat. No. 4,177,542 issued to Denney on Dec. 11, 1979; U.S. Pat. No. 3,925,901 issued to McCormick on Dec. 16, 1975; U.S. Pat. No. 3,843,119 issued to Davis on Oct. 22, 1974; U.S. Pat. No. 3,369,809 issued to Morrill, Jr. on Feb. 20, 1968; U.S. Pat. No. 3,119,614, issued to Berry on Jan. 28, 1964; U.S. Pat. No. 324,498, issued to Surbaugh on Aug. 18, 1885; and United States Patent Application 20140329650 filed by Watry on Nov. 6, 2014. Each of these patents and publications is hereby expressly incorporated by reference in their entirety.

In addition to the prior art patents cited above, it is important to understand a little additional background information. Athletic trainers, coaches, athletes, fitness enthusiast, and personal trainers all recommend stretching to help performance, reduce injuries, and increase range of motion for flexibility. It is important to keep flexible for good health, athletic performance, and to help reduce injuries.

Body stretching is a broad term and it is important to define the specific types of stretching as it will become important as it relates to the present invention. Static stretching means holding a stretch in a challenging but comfortable position for a period of time, usually between 10 and 30 seconds. It is considered safe and more effective at the end of the activity. Dynamic Stretching are active movements, challenging but comfortable, through a range of motion repeatedly, usually 10 repetitions, that bring forth a stretch but are not held in the end position. Dynamic stretching requires more thoughtful coordination than static stretching. It is gaining more favor among athletes and coaches because of the apparent benefits improving functional range of motion in sports and activities. Active stretching means you are stretching a muscle by actively contracting the opposite muscle to the one that you are stretching. An example would be contracting the quadriceps muscle while stretching the hamstring muscle. Passive Stretching means you are using some sort of outside assistance to achieve a stretch, usually another person such as an athletic trainer.

For several years it was thought that static stretching was the safest and best way to stretch before and after exercise for sporting events. In recent years, the NBA, NFL, Track and Field and other sports have changed to dynamic stretching prior to the sporting event because it is more effective as a warm up procedure to prepare the muscles for activity and use Static stretching at the end of the workout as part of the cool down phase of training. The present invention is designed to accommodate both dynamic and static stretching in one portable apparatus.

From these prior references and information it may be seen that the prior art is very limited in its teaching and utilization, and an improved dynamic body stretching apparatus is needed to overcome these limitations.

SUMMARY OF THE INVENTION

The present invention is directed to an improved dynamic body stretching device using an elastic loop stitched to a static loop. The elastic loop forms a hand strap with a threaded on end grip handle. The static loop forms a foot loop and between the elastic loop and the foot loop are threaded on handgrips held in position by strap locks. The handgrips have a mirrored end ovoid shape allowing gripping and pulling from alternative directions with a central axial aperture so that the static strap can be folded and threaded through the aperture.

In use, the user's foot is placed in the foot loop and the hands hold onto the opposite end of the apparatus which has an elastic loop with a soft foam or rubber flexible end grip. The user will dynamically stretch specific muscle groups with continuous repetition, changing body positions without the need to let go of the apparatus except to change legs during lower body stretches. The dynamic stretch warm up may last a few minutes and by targeting large muscle groups the heart rate is slightly elevated providing oxygen to the muscles and increasing range of motion. For upper body stretching the center handgrips allow for different people whether short or tall in stature. Each of the mirror ovoid hand grips located between the static foot loop and the elastic loop strap offer the person a choice to pull in either direction providing more options to pull up and down or across the body. Other advanced upper body stretches allow the person to anchor one end to a fixed secure point via a carabiner or equivalent which allows the person to target specific muscles by grabbing the most comfortable handgrip based on their arm length and stature. The elasticity of flat bungee strap loop for example safely stretches to 50 percent of the bungee length. This elasticity component is vital as it provides a transition from the static portion of the apparatus and serves as a shock absorber effect which is dynamic and desired by athletic trainers and coaches to avoid over stretching which can cause soreness and injuries. There are several stretches that combine the elastic loop strap and the middle mirror ovoid handgrips. In addition, there are several stretches that involve only the static foot loop and the elastic loop strap. In another embodiment, the handgrips can be made with foam material that floats so the person can use the apparatus in aquatic exercise classes to stretch the upper body.

One advantage of the present invention include that the present invention allows for both static and dynamic stretching without an anchor point.

A further advantage of the present invention are the mirror ovoid handgrips with rounded ends to allow the user to pull from either direction which is helpful in many stretch positions.

A still further advantage are the loops at each end to allow the user to comfortably stretch in an elongated position.

Yet another advantage is the elastic being limited to one end of a static strap allowing for both static and dynamic stretching.

Another advantage is that the plurality of mirror ovoid handgrips with rounded ends allows the operator to perform dynamic, active, or static stretches.

Another advantage is that the present invention has a comfortable handgrip attached to the elastic end as well as ergonomically designed mirror ovoid handgrips for comfort under tension.

Another advantage is that the present invention is designed specifically for dynamic, static, and active stretching without a fixed anchor point.

Another advantage is that the present invention has a ratio of 25 percent elastic (which is designed to stretch 50 percent comfortably) to 75 percent static which is more comfortable and effective for dynamic stretching with continuous repetitions to warm up for sports activity.

Another advantage is that the present invention has an additional advantage allowing the user to perform static stretches at the end of the activity as part of the cool down phase of training. This is accomplished by using the static foot strap loop and a plurality of ergonomically designed handgrips.

The consensus in exercise physiology is that it is best to do dynamic stretching before the sporting event or activity and static stretching at the end of the activity. Another advantage is that the present invention allows for dynamic, static, and active stretching comfortably.

Another advantage is that the present invention is practical for all sports activities which can stretch both upper and lower body.

Therefore, in view of the above and other disadvantages of prior art body stretching apparatus, it is an object of the present invention to provide a dynamic, static, and active stretching apparatus that enables the user to stretch each muscle group with safe repetitions as part of a warm up routing that prepares the body for the activity in a safe comfortable manner.

It is a further object of the present invention to provide an elastic strap on one end to gradually increase tension while stretching to reduce over stretching which can cause soreness and injury.

It is a further object of the present invention to provide one end of the invention elasticity with a flexible handgrip to comfortably hold while stretching.

It is a further object of the present invention to provide multiple mirror ovoid handgrips that can be pulled from either direction while stretching the upper and lower body.

It is a further object of the present invention to provide handgrips and a static foot strap to be used for static stretching as part of the cool down phase of training.

It is a further object of the present invention to provide an apparatus that can be used for upper and lower body stretches to target specific muscle groups that are hard to stretch allowing continuous repetitions to actively warm up the muscles prior to activity or sporting event.

It is a further object of the present invention to provide handgrips and static foot loop strap to be used to static stretching as part of the cool down after exercise.

It is a further object of the present invention to create a versatile apparatus that gives the operator many options for handholds as there are dozens of different stretches that are more efficient to use hand grips and or loops in combination.

It is a further object of the present invention to combine a static loop on one end of the invention with the opposite end providing elasticity via an elastic strap loop on the opposite end which is a safer warm up routine as the elastic end acts as a buffer or shock absorber to help prevent over stretching which is common with static stretching and can cause soreness.

It is a further object of the present invention to be buoyant to accommodate aquatic exercise classes via the option for floatable foam handgrips as required for stretching in the water.

Additionally, it is an object of the present invention to provide a small, practical, inexpensive training device which provides new technology that has been proven in exercise physiology as a more effective way to warm up for fitness enthusiasts, athletes, and physical therapy patients that is easily transportable.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
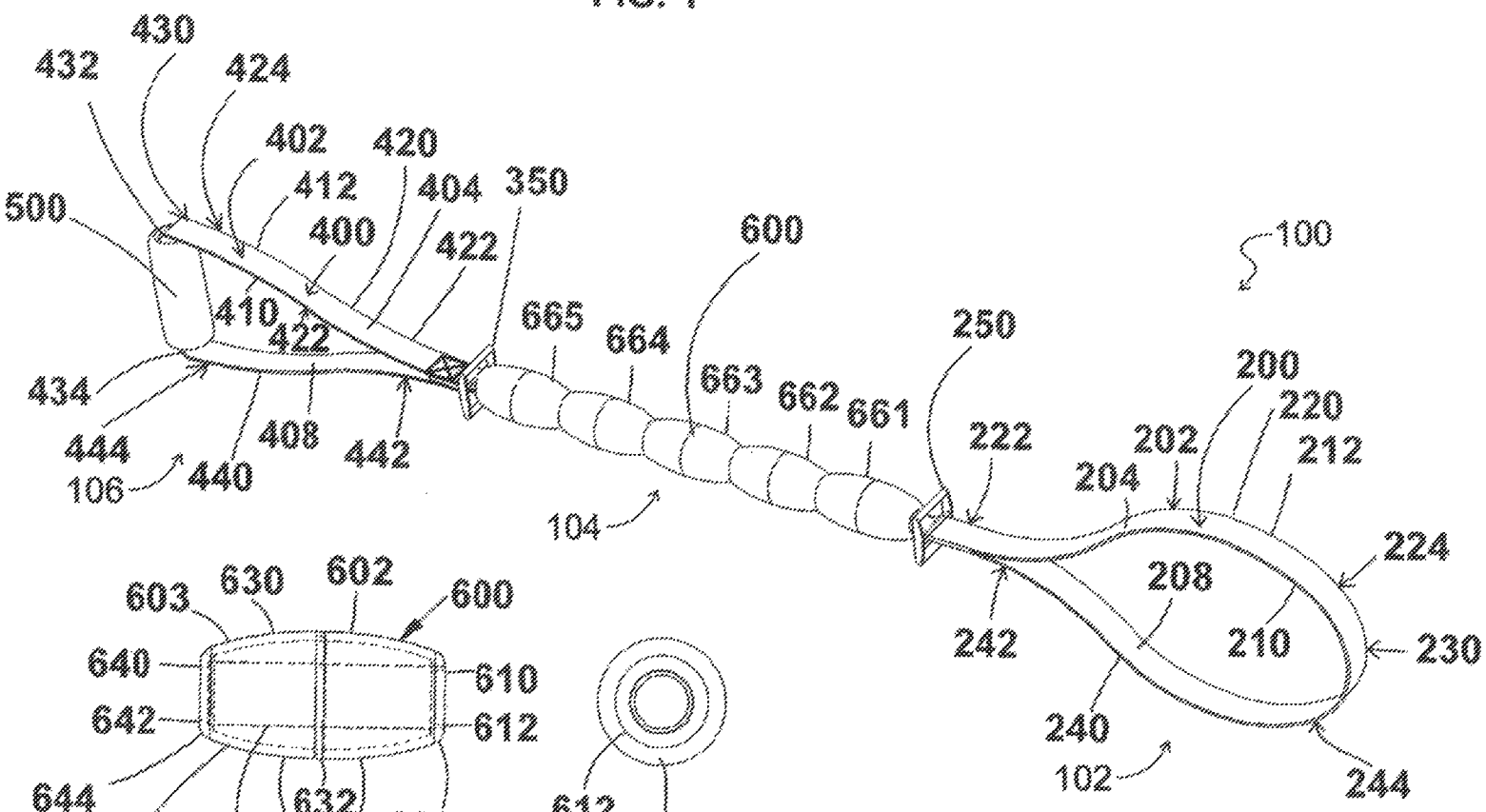
FIG. 1 is an isometric view of the current body stretching apparatus.
Figure 2:
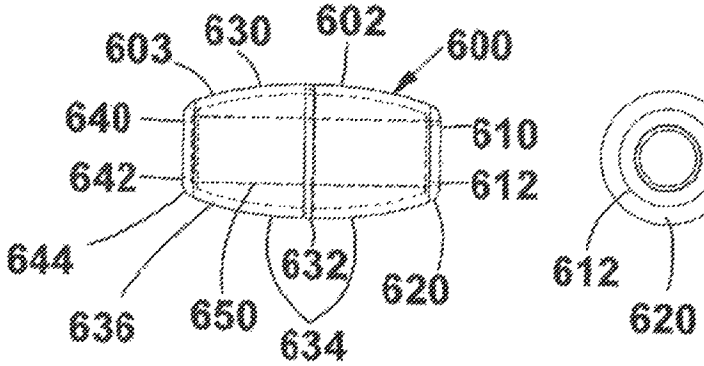
FIG. 2 is a side of the handgrip with dashed lines showing the internal structure.
Figure 3:
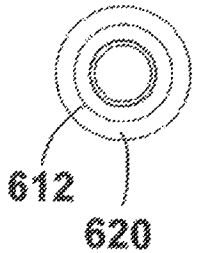
FIG. 3 is an end view of the handgrip. front view, in a horizontal plane, of the plastic handgrip.
Figure 4:
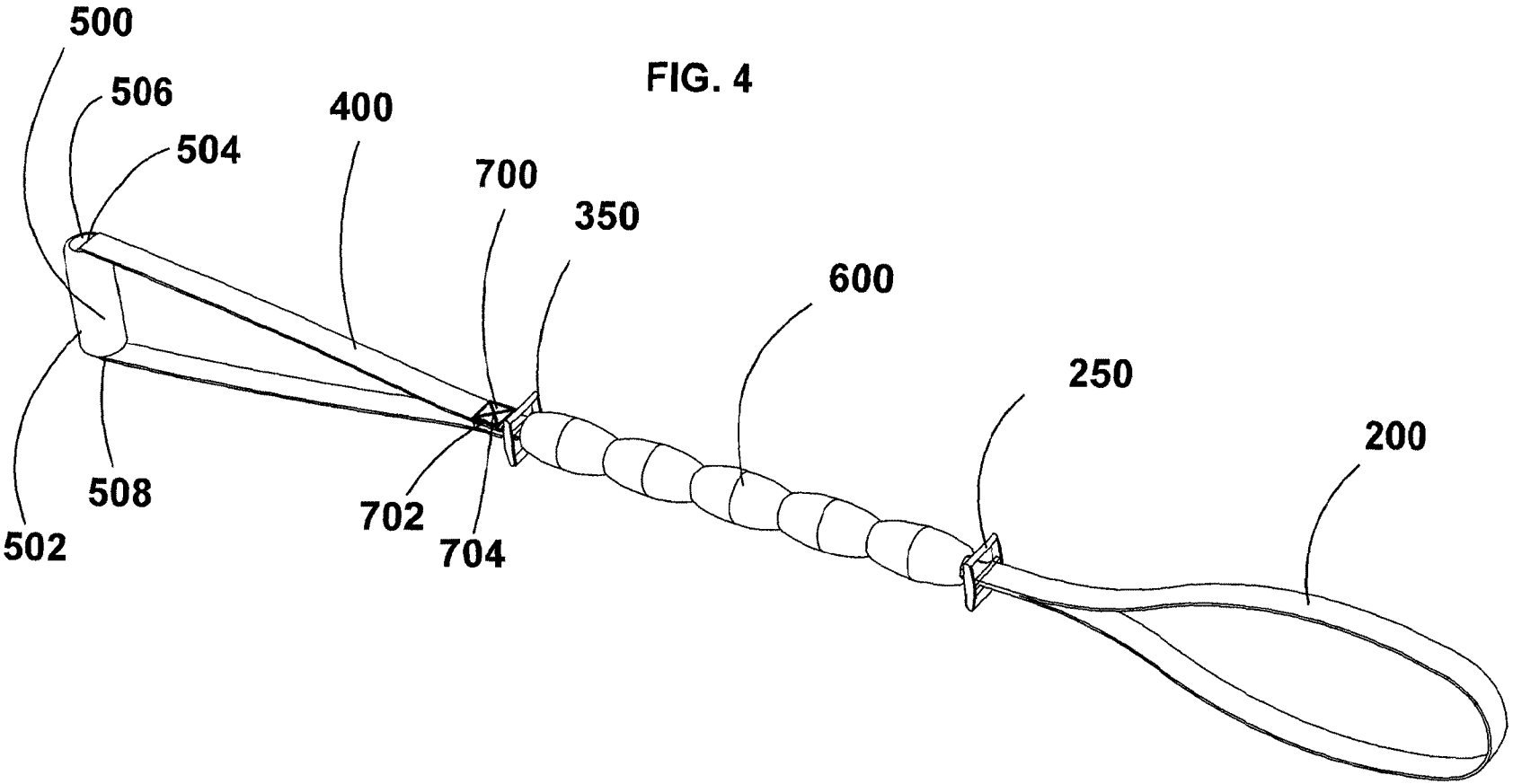
FIG. 4 is an isometric view of a stretched version of the body stretching apparatus.
Figure 5:
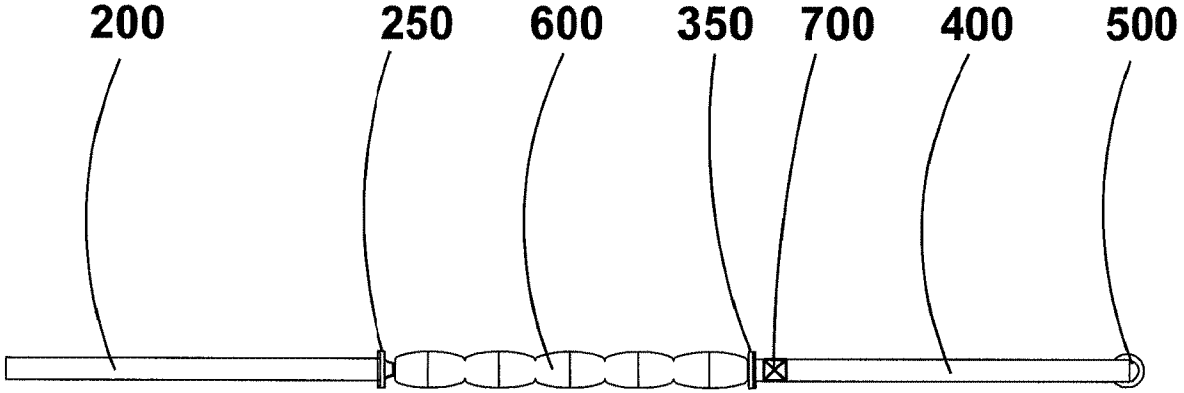
FIG. 5 is a side view of the body stretching apparatus.
Figure 6:
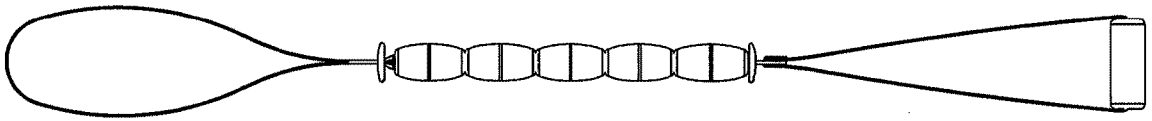
FIG. 6 is a top view of the body stretching apparatus.

Referring now to FIGS. 1 through 10 of the drawings, one may understand various aspects and uses of one embodiment of the present invention's dynamic body stretching apparatus 100 for use by a user 10. For consistency in terminology, the user 10 is described as follows. The user 10 is shown with a torso 11 connected to an upper arm 12 connected by an elbow 14 to a lower arm 16 connected by a wrist 18 to the user's hand 20. Also shown connected to the user's torso 11 is an upper leg 22 connected by a knee 24 to a lower leg 26 connected by an ankle 28 to the user's foot 30.

The dynamic body stretching apparatus 100 includes a loop lower end 102 connected by a middle body 104 to a loop upper end 106. The lower end 102 and middle body are formed using a base of a static lower strap 200 and the upper end 106 is formed using a base of an upper elastic strap 40. The static lower strap 200 is approximately fifty seven to seventy three inches in length before it is folded into a loop and the elastic upper strap 400 has an unstretched elastic length of approximately twenty four inches to thirty two inches in length before it is folded into its loop. This maintains an ideal ratio of approximately twenty five percent unstretched elastic material length to seventy five percent static material length. The static lower strap 200 is folded into a loop and the ends are approximately one and a quarter inches with the upper elastic strap 400 and this overlap is secured with sewing stitches 700. The sewing stitches 700 include at least cross stitches but may be as detailed as a rectangular outline stitch 702 and an inner cross stitch 704. The stitches 700 are preferably formed from an appropriate synthetic material such as nylon thread that can withstand the stresses involved in the use of the device as well as the long term environmental considerations of exposure to seat, temperature changes, humidity variations, sunlight exposure, transportation, storage, and other environmental characteristics associated with indoor and outdoor sports where the user 10 benefits from stretching with the apparatus 100.

The static lower strap 200 is formed using a flat flexible static body 202 preferably formed from a nylon webbing or the like. The static lower strap 200 includes an outer static face 204, an inner static face 208, a first static strap edge 210, and a second static strap edge 212. The static lower strap 200 is folded to form a first static side 220 joined by a flexible static end curve 230 to a second static side 240. The first static side 220 extends from a first static lock end 222 to a first static curve end 224. Similarly, the second static side 240 extends from a second static lock end 242 to a second static curve end 244. In this manner, the first static side 220 and the second static side 240 are equal in length.

A static end tension lock 250 is secured to the first static side 220 and second static side 240 by routing the static sides 220, 240 under a first static cross bar 252, over a second static cross bar 254, and back under a third static cross bar 256. The cross bars 252, 254, 256 are joined by a first side static connecting frame 258 and second side static connecting frame 260 such that they are fixably positioned to frictionally engage the outer static face 204 of the static lower strap 200. The static end tension lock 250 defines the foot loop lower end 102 and the middle body 104.

In the middle, the static lower strap 200 forms parallel mid straps 300 with a first middle strap section 302 and second middle strap section 304. Both middle strap sections 302, 304 are placed with their various faces 204, 208 aligned and then have the a first static strap edge 210, and a second static strap edge 212 folded toward each other to form a longitudinal fold 306 to pass through the strap aperture 650 in the mirror ovoid mid handgrips 600. In this manner, the mirror ovoid mid handgrips 600 are threaded onto the parallel mid straps 300. In the preferred embodiment, four to five handgrips 600 are provided but it should be understood that the number of handgrips is dependent only on the length of the parallel mid straps 300. The five provided handgrips 600 include the first handgrip 661, second handgrip 662, third handgrip 663, fourth handgrip 664, and fifth handgrip 665.

The mirror ovoid mid handgrips 600 are formed with a grip body 602 including a first end 610 with a first flattened face 612 connected by a transition radius 620 to a middle section 630. The middle section 630 is then connected to the second transition radius 644 to connected to the second flattened face 642 on the second end 640. The overall length of each handgrip 600 is approximately three inches and the ends are approximately one inch wide. The middle section 630 includes a central mirror line 632 that defines a mirroring point for the two center to end reductions 634 such that they are mirror images of each other. The width of the handgrip 600 at the mirror line is approximately one and five eighth inches. The center to end reductions 634 includes a reducing ovoid outer surface 636 that is gripped by the user's hand 20 such that these surfaces may be textured if desired. Each end 610, 640 forms the termination point for the strap aperture 650 that passes all the way through the mid handgrips 600. The strap aperture is approximately five eights of an inch in diameter. The mirror ovoid mid handgrips 600 are preferably formed from a hard plastic or can even be formed from foam to give the apparatus 10 buoyancy for use in water.

The mirror ovoid mid handgrips 600 are adjustably locked in place by the static end tension lock 250 and the joint end tension lock 350. Because both the locks 250, 350 can be repositioned and the handgrips 600 are slideably adjustable along the length of the mid parallel straps, the apparatus 100 is extremely adjustable and versatile for many body sizes and stretch positions. The parallel mid straps 300 pass through the joint end tension lock 350 in a similar manner to the static end tension lock 250. The joint end tension lock 350 includes a first joint cross bar 352, second joint cross bar 354, and third joint cross bar 356 joined by a first side joint connecting frame 358 and second side joint connecting frame 360.

The static lock ends 222, 242 of the parallel mid straps 300 are lapped over and connected with stitches 700 to the first elastic lock end 422 and second elastic lock end 442 of the elastic upper strap 400.

The elastic upper strap 400 is formed with a flat elastic body 402 including an outer elastic face 404, an inner elastic face 408, a first elastic strap edge 410, and a second elastic strap edge 412. In this manner, the elastic upper strap 400 is basically constructed as a loop of elastic flat bungee cord.

The flat elastic body 402 runs from a first elastic side 420 extending from a first elastic lock end 422 to a first elastic curve end 424 where it transitions to a first flexible elastic end curve 430. The first flexible elastic curve end 430 transitions to a flexible elastic cross section 432 and then to a second flexible elastic end curve 434 to a second elastic curve end 444 of the second elastic side 440 that terminates in the second elastic lock end 442. In this manner, the first elastic side 420 and the second elastic side 440 are equal in length.

The end grip handle 500 defines an inner pass through aperture 504. The flexible elastic cross section 432 passes through the inner pass through aperture 504 in the end grip handle 500. The end grip handle 500 also includes an outer grip surface 502. Both the inner pass through aperture 504 and the outer grip surface 502 extend from the first handle end 506 to the second handle end 508. The end grip handle 500 is preferably made from a foam rubber.

Figure 7:
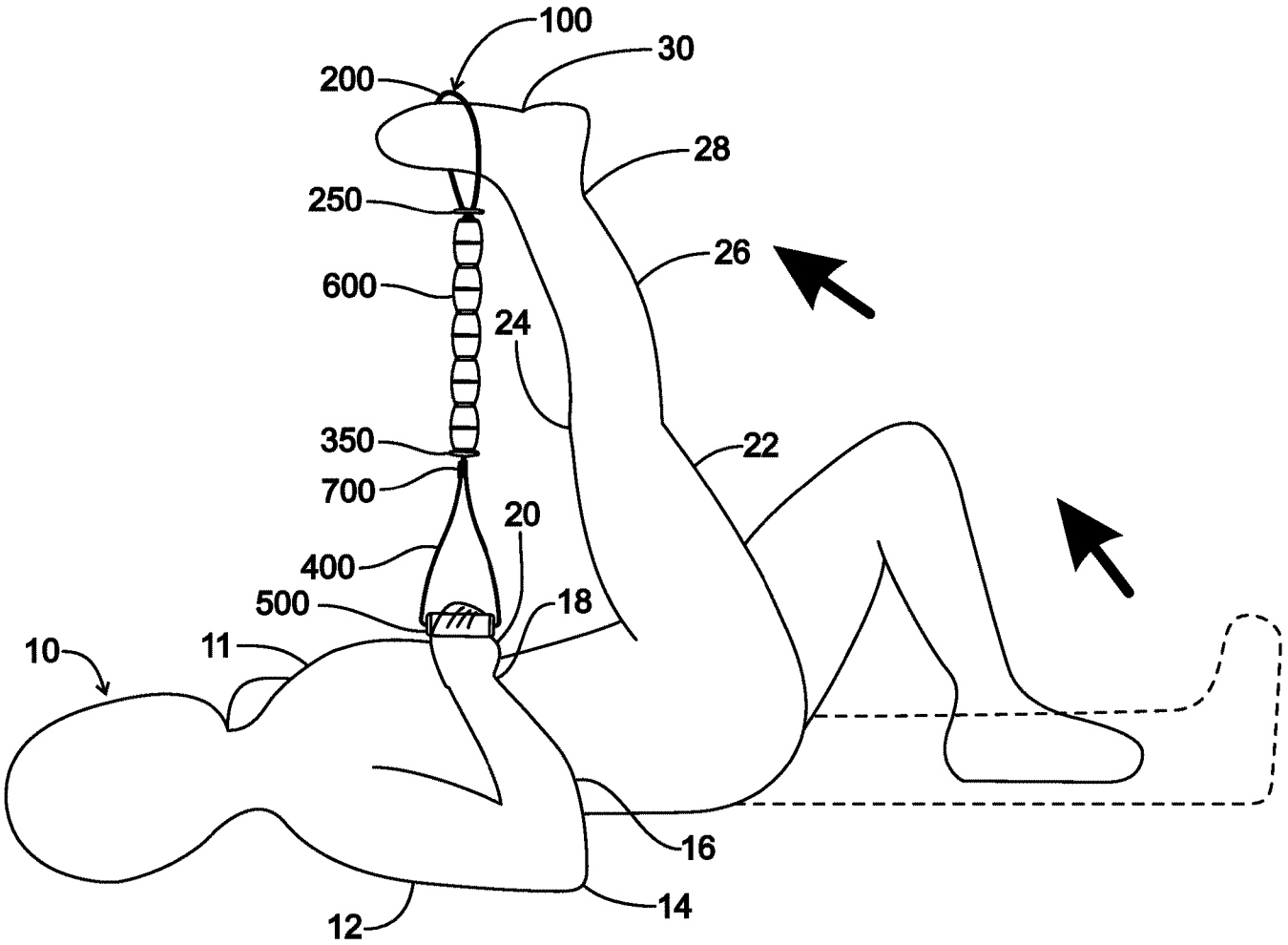
FIG. 7 is a side view of an operator using the dynamic body stretching apparatus of the present invention between an arm and leg.

FIG. 7 of the drawings shows the user lying on their back with the torso 11 in a horizontal position for using the stretching apparatus 100 between a hand 20 and foot 30 to stretch the connecting muscles and tissues. The user's foot 30 is placed in the lower loop end 102. The static end tension lock 250 is strategically placed as to provide enough space to put the foot 30 into the lower loop end 102. The joint end tension lock 350 holds the handgrips 600 in place. The user 10 grips the end grip handle 500 on the upper loop end 106 to lift the foot 30 upwards thereby stretching the connecting muscles and tissues.

Figure 8:
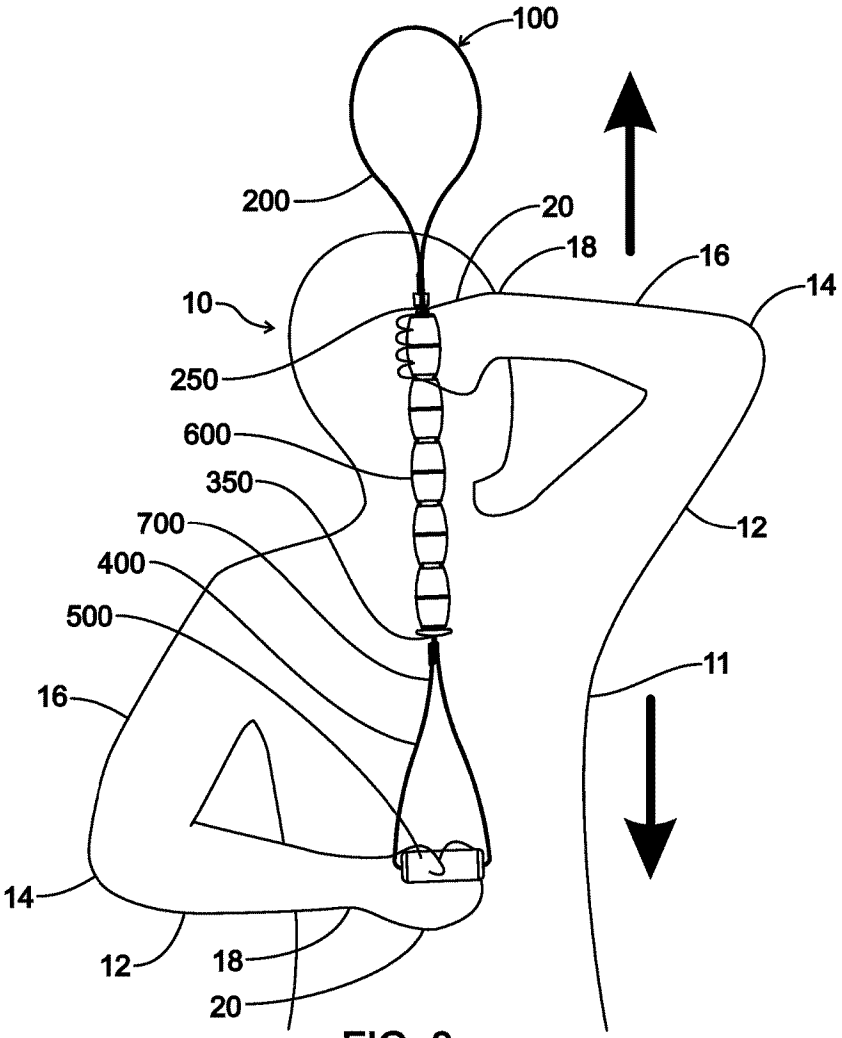
FIG. 8 is a side view of a an operator using the dynamic body stretching apparatus of the present invention between two arms.
Figure 9:
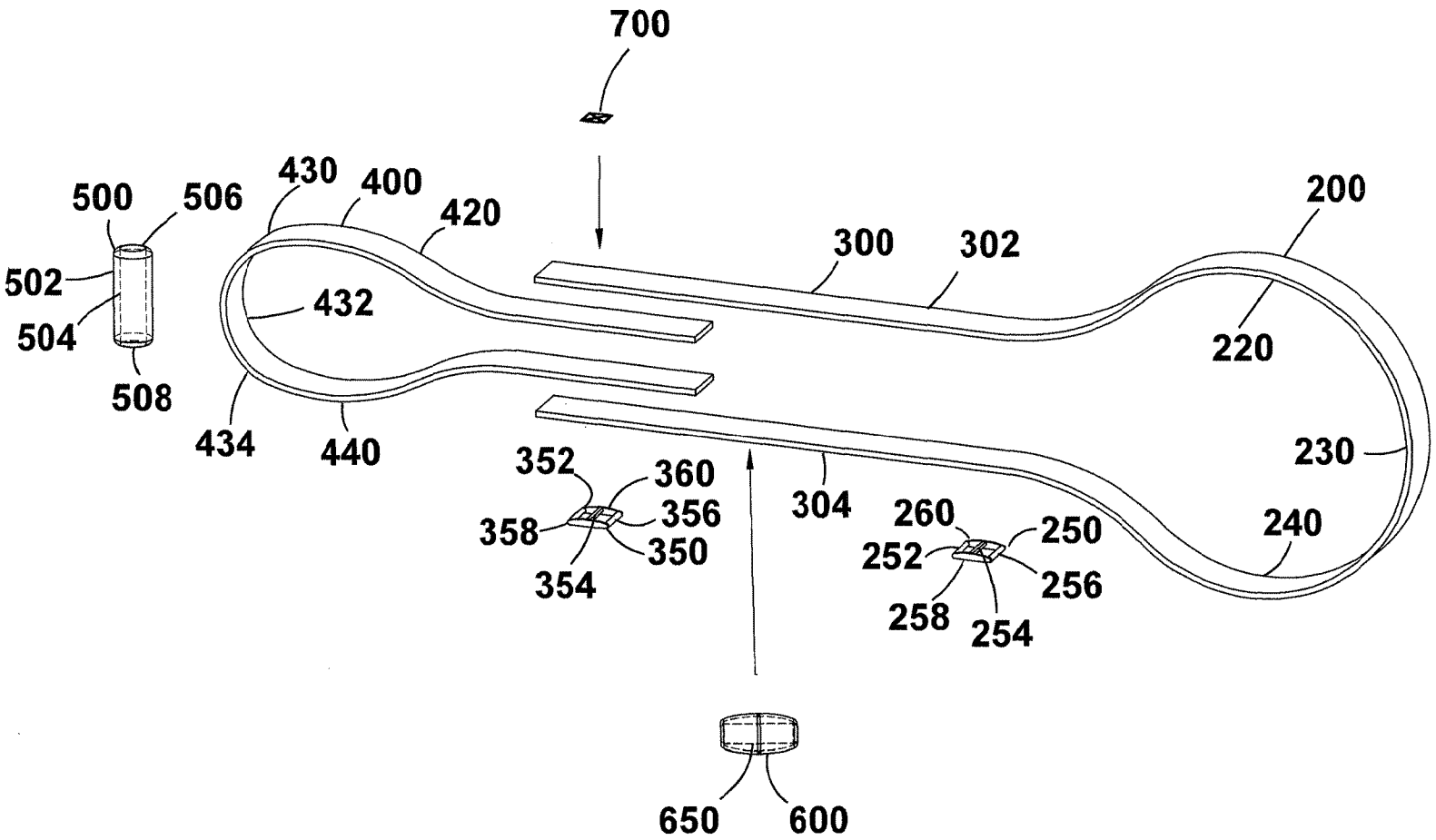
FIG. 9 is an exploded view the dynamic body stretching apparatus.
Figure 10:
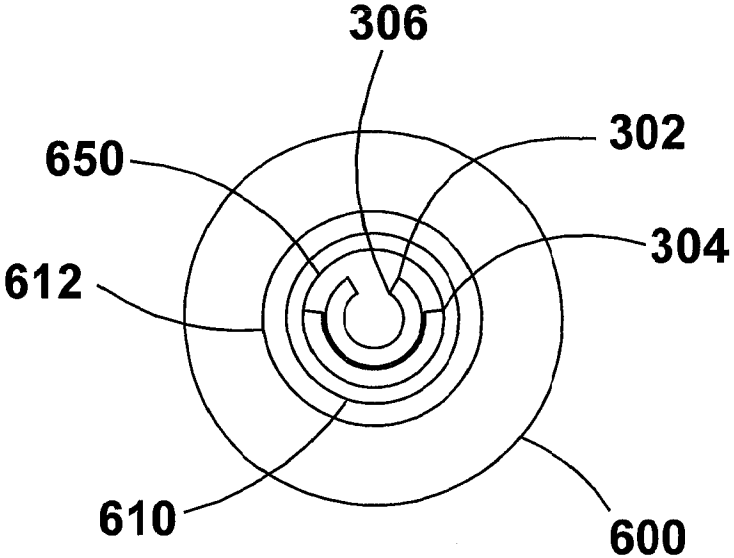
FIG. 10 is an end view of the handgrip showing the longitudinal fold of the parallel mid straps.

FIG. 8 of the drawings shows the user standing with the torso 11 in a vertical position for using the stretching apparatus 100 between two hands 20 to stretch the connecting muscles and tissues. The upper hand 20 grips one of the handgrips 600 being held in place by the static end tension lock 250. The joint end tension lock 350 also holds the handgrips 600 in place. The user 10 grips the end grip handle 500 and the two hands 20 apply opposing forces to the end of the device 100 thereby stretching the connecting muscles and tissues either up, down, or they may apply equal forces to do isometric exercises.

Reference numerals used throughout the detailed description and the drawings correspond to the following elements:

- User 10
  - Torso 11
  - Upper arm 12
  - Elbow 14
  - Lower arm 16
  - Wrist 18
  - Hand 20
  - Upper leg 22
  - Knee 24
  - Lower leg 26
  - Ankle 28
  - Foot 30
- dynamic body stretching apparatus 100
  - lower loop end 102
  - middle body 104
  - upper loop end 106
- static lower strap 200
  - flat flexible static body 202
    - outer static face 204
    - inner static face 208
    - first static strap edge 210
    - second static strap edge 212
  - first static side 220
    - first static lock end 222
    - first static curve end 224
  - flexible static end curve 230
  - second static side 240

-continued

- second static lock end 242
  - second static curve end 244
- static end tension lock 250
  - first static cross bar 252
  - second static cross bar 254
  - third static cross bar 256
  - first side static connecting frame 258
  - second side static connecting frame 260
- parallel mid straps 300
  - first middle strap seciton 302
  - second middle strap section 304
  - longitudinal fold 306
- joint end tension lock 350
  - first joint cross bar 352
  - second joint cross bar 354
  - third joint cross bar 356
  - first side joint connecting frame 358
  - second side joint connecting frame 360
- elastic upper strap 400
  - flat elastic body 402
    - outer elastic face 404
    - inner elastic face 408
    - first elastic strap edge 410
    - second elastic strap edge 412
  - first elastic side 420
    - first elastic lock end 422
    - first elastic curve end 424
  - first flexible elastic end curve 430
  - flexible elastic cross section 432
  - second flexible elastic end curve 434
  - second elastic side 440
    - second elastic lock end 442
    - second elastic curve end 444
- end grip handle 500
  - outer grip surface 502
  - inner pass through aperture 504
  - first handle end 506
  - second handle end 508
- mirror ovoid mid handgrips 600
  - grip body 602
  - body shape 603
    - first end 610
      - first flattened face 612
    - transition radius 620
    - middle section 630
      - central mirror line 632
      - center to end reduction 634
        - reducing ovoid outer surface 636
    - second end 640
      - second flattened face 642
    - second transition radius 644
  - strap aperture 650
  - first handgrip 661
  - second handgrip 662
  - third handgrip 663
  - fourth handgrip 664
  - fifth handgrip 665
- sewing stitches 700
  - rectangular outline stitch 702
  - inner cross stitch 704

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A dynamic body stretching apparatus, comprising:

a static lower strap forming a lower loop end and middle body, the static lower strap including first and second static lock ends;

an upper elastic strap forming an upper end loop, the upper elastic strap including first and second elastic lock ends;

the first and second static lock ends lapped over and connected to the first and second elastic lock ends with stitches at a single connection location; and an end grip handle positioned on the upper elastic strap.

2. A dynamic body stretching apparatus, comprising:

a static lower strap forming a lower loop end and middle body, the static lower strap including first and second static lock ends;

an upper elastic strap forming an upper end loop, the upper elastic strap including first and second elastic lock ends;

the first and second static lock ends lapped over and connected to the first and second elastic lock ends with stitches at a single connection location; and at least one ovoid mid handgrip positioned on the static lower strap.

3. The apparatus of claim 2, the at least one ovoid mid handgrip, each handgrip having ends which have a shape that mirror one another in a center to end reduction.

4. The apparatus of claim 2, the at least one ovoid mid handgrip having two mirror shaped ends.

5. The apparatus of claim 2, the at least one ovoid mid handgrip slideably adjustable along the static lower strap.

6. The apparatus of claim 2, further comprising:

at least one static end tension lock positioned on the static lower strap adjacent to the at least one ovoid mid handgrip.

7. The apparatus of claim 2, the at least one ovoid mid handgrip including a first handgrip and a second handgrip, the first and second handgrips having the same shape.

* * * * *